US005222300A

United States Patent [19]

Althaus et al.

[11] Patent Number: 5,222,300

[45] Date of Patent: Jun. 29, 1993

[54] RAZOR HEAD, ESPECIALLY RAZOR BLADE UNIT OF A WET RAZOR

[75] Inventors: Wolfgang Althaus, Wuppertal; Michael Schwarz, Herne, both of Fed. Rep. of Germany

[73] Assignee: Wilkinson Sword Gesellschaft mit beschr/ nkter Haftung, Solingen, Fed. Rep. of Germany

[21] Appl. No.: 906,210

[22] Filed: Jun. 25, 1992

[30] Foreign Application Priority Data

Jul. 3, 1991 [DE] Fed. Rep. of Germany ... 9108212[U]

[51] Int. Cl.[5] ..... B26B 21/14

[52] U.S. Cl. ..... 30/50; 30/47; 30/57

[58] Field of Search ..... 30/50, 47, 57, 77

[56] References Cited

U.S. PATENT DOCUMENTS

| | | | |
|---|---|---|---|
| 3,950,848 | 4/1976 | Goldstein | 30/50 |
| 4,063,354 | 12/1977 | Oldroyd et al. | 30/47 |
| 4,347,663 | 9/1982 | Ullmo | 30/47 |
| 4,442,598 | 4/1984 | Jacobson | 30/77 |
| 4,621,424 | 11/1986 | Jacobson | 30/47 |
| 4,939,840 | 7/1990 | Butka | 30/50 |
| 5,074,042 | 12/1991 | Althaus et al. | 30/50 |

FOREIGN PATENT DOCUMENTS 0312663 4/1989 European Pat. Off. .

*Primary Examiner*—Douglas D. Watts
*Assistant Examiner*—Hwei-Siu Payer
*Attorney, Agent, or Firm*—Robert W. Becker & Associates

[57] ABSTRACT

A razor head, especially a razor blade unit of a wet razor, with the razor head being disposed at the front end of a handle. A single or double razor blade is yeildingly mounted in a plastic housing. To improve the spring or yielding mounting of the single or double razor blades, the latter are secured to a blade member that is mounted on a four-pivot articulation arrangement. This arrangement is provided with two swivel levers, each of which is pivotable between the plastic housing and the blade member on pivot points that have axes that extend parallel to the cutting edges of the razor blades. The swivel levers are pivotable against a spring force.

17 Claims, 7 Drawing Sheets

10
10
3
5
5
7'
8
8
4
8
11
7
8
2

RAZOR HEAD, ESPECIALLY RAZOR BLADE UNIT OF A WET RAZOR

BACKGROUND OF THE INVENTION

The present invention relates to a razor head, especially a razor blade unit of a wet or safety razor, with the razor head being disposed at the front end of a handle. A single or double razor blade is yieldingly disposed in a plastic housing.

It should be noted that if the razor is a disposable razor, a single or double razor blade is fixedly embedded in the razor head in a plastic housing. If the razor head is a separate component, and can be secured to a handle, for which purpose both the handle and the razor head have corresponding interlocking means, the arrangement is referred to as a so-called razor blade unit. Pursuant to one known razor blade unit of a wet razor, a plastic housing having a forward guide strip is provided. To form a double razor blade, disposed within this plastic housing are two razor blades, each of which is separately yieldingly mounted. For this purpose, each of the two razor blades is disposed on a lateral spring tongue, thus making it possible for the razor blades to respectively adapt to the contour of a face during a shaving process.

Unfortunately, a drawback of this known system is that the angle, and hence the position, of the razor blades does not remain constant while shaving. Thus, undesired oscillations or movements in the respective razor blades can occur, which can then result in an unsatisfactory shave.

It is therefore an object of the present invention to provide a razor head, and especially a razor blade unit of a wet razor, that has an improved spring or yielding mounting of the single or double razor blades.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
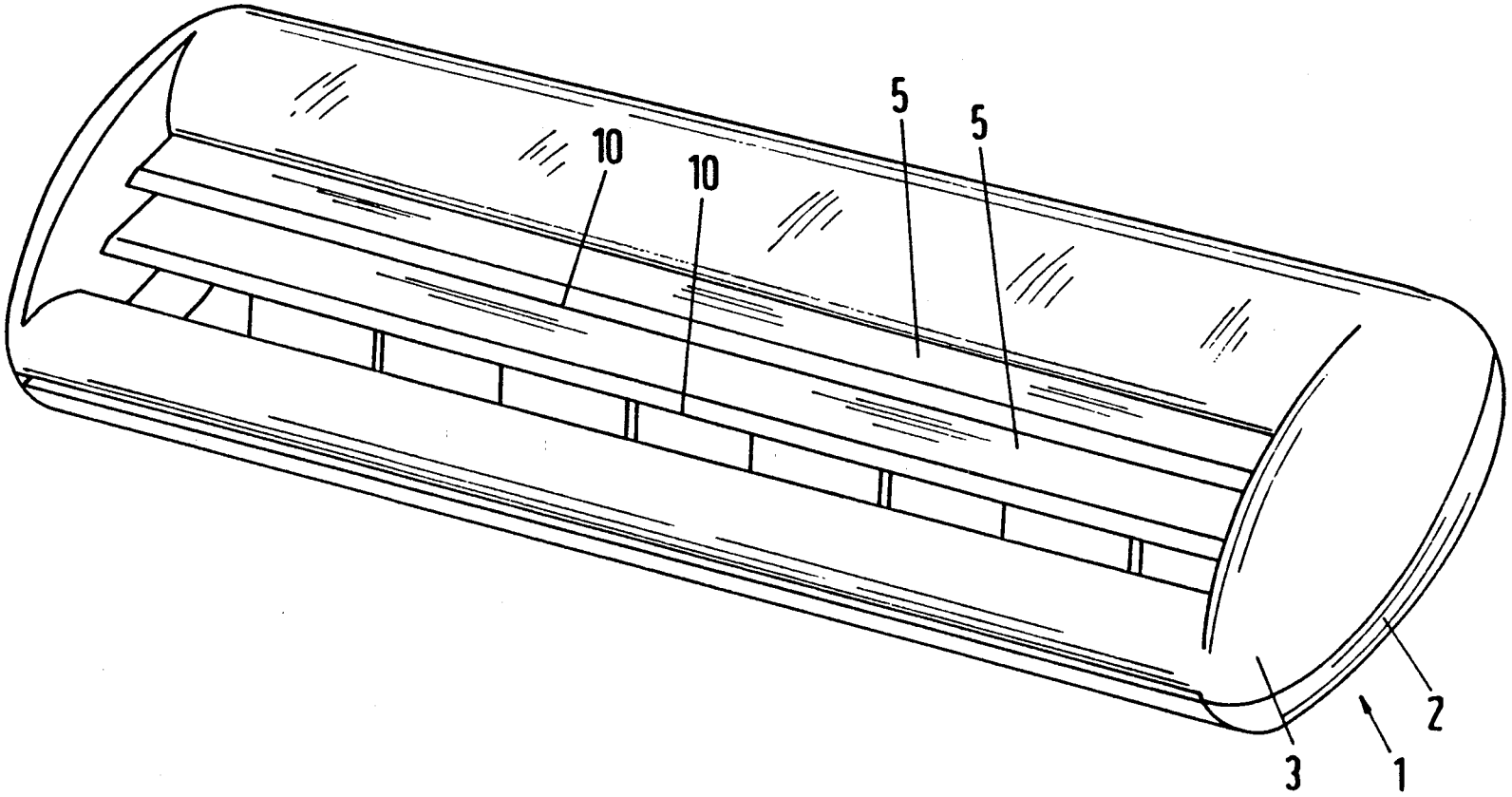
FIG. 1 is a perspective view of one exemplary embodiment of the razor head of the present invention in the form of a razor blade unit of a wet razor.
Figure 2:
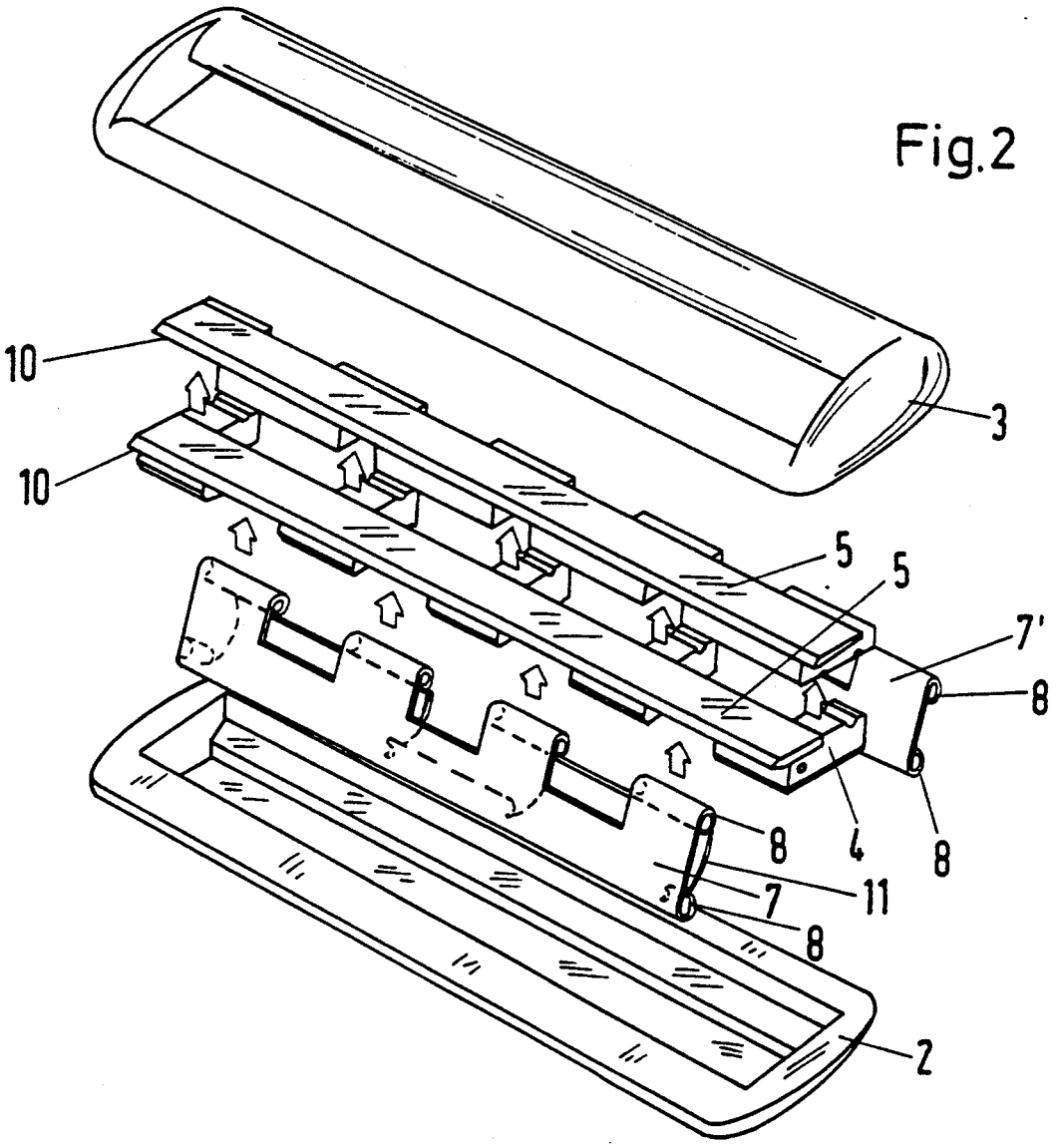
FIG. 2 is an exploded view showing the razor blade unit of FIG. 1 prior to assembly.
Figure 3:
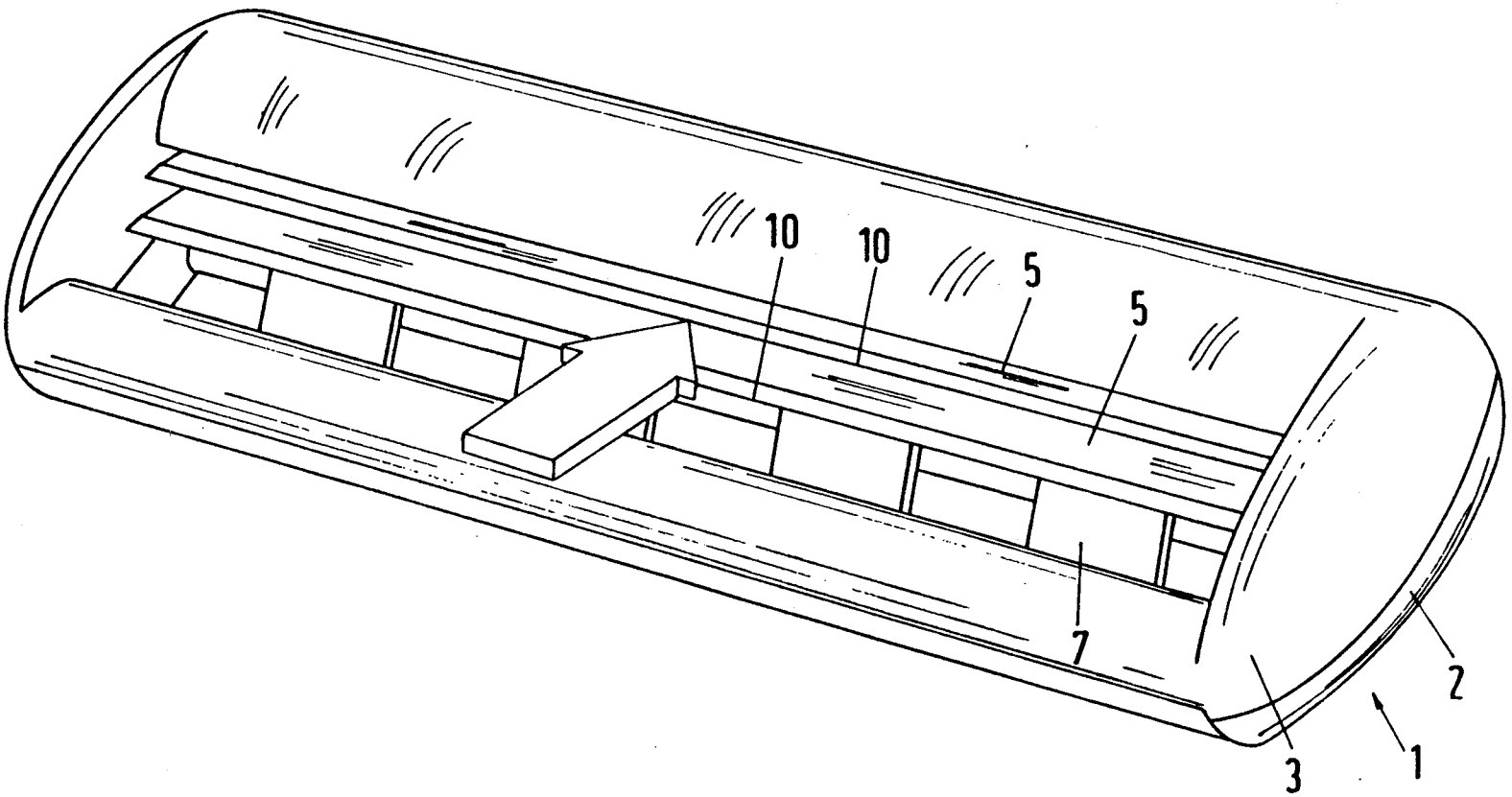
FIG. 3 is a view similar to FIG. 1 but with the blade member deflected out of its normal or starting position.

The razor head of the present invention is characterized primarily in that the single or double razor blade is secured to a blade member, which in turn is mounted on a four-pivot articulation arrangement that has two swivel levers, each of which is pivotably mounted between the plastic housing and the blade member at pivot points having axes that extend parallel to the cutting edges of the razor blades, with the swivel levers being pivotable against the spring force.

A razor head, especially a razor blade unit of a wet razor, that is constructed pursuant to the teaching of the present invention so that it has a single or double razor blade secured to a blade member has the advantage of providing an improved spring or yielding mounting. For example, when a conventional double razor blade is used, the two individual razor blades, which are mounted so as to be parallel to one another, are displaceable in a parallel and synchronous manner. By means of the four-pivot articulation arrangement, a controlled and directed movement of the razor blade member is achieved, with this blade member carrying out a combination rotational and translatory movement. The corresponding movement guidance of the blade member, and hence of the razor blades, is a function of an appropriate positioning of the pivot points. By means of this controlled and directed mounting of the blades, a movement can be achieved whereby no undesired oscillations or movements in the razor blade or blades occurs, so that an optimum shaving efficiency can be achieved. The spring or yielding arrangement of the blade member within the plastic housing is such that during a shaving process the blade member, together with the razor blades, essentially moves in the direction toward the rear side. As soon as pressure is no longer applied to the razor blade member, the spring returns the blade member toward the front into the normal or starting position. A further advantage of the inventive razor head is that only slight frictional forces occur in the pivot points, and the razor head is not susceptible to the effects of dirt.

Pursuant to one preferred specific embodiment of the present invention, it is proposed that one of the swivel levers be linked to a front side portion of the blade member while the other swivel lever is linked to a rear side portion of the blade member. This results in optimum possibilities for a both rotational as well as translatory movement guidance of the blade member. The expression rear side linking of the swivel lever also means that the possibility is provided that the rear side of the blade member have a recess within which the swivel lever is so to speak linked within the blade member.

Pursuant to a first alternative specific embodiment it is proposed that the other end of the swivel lever that is linked in the front side portion of the blade member be linked to the forward or central, lower portion of the plastic housing, while the other end of the swivel lever that is disposed in the rear-side portion of the blade member be similarly linked to the lower portion of the plastic housing, but rearwardly of the aforementioned linkage. The arrangement is such that the four pivot points are preferably essentially the corners of a parallelogram.

Pursuant to a second alternative embodiment, it is proposed that the other end of the swivel lever that is linked to the front side portion of the blade member be linked to the forward or central, lower portion of the plastic housing, while the other end of the swivel lever that is linked to the rear-side portion of the blade member be linked to the rear, upper portion of the plastic housing. If the plastic housing is provided with the conventional rear cap or cover means, it is then proposed pursuant to a further specific embodiment that the swivel lever that is linked in the rear, upper portion of the plastic housing be linked essentially below the cover means.

It is to be understood that these two alternatives are only two possible specific exemplary embodiments for mounting the blade member within the plastic housing to enable a combination rotational and translatory movement. However, the principle of the four-pivot articulation arrangement is not to be limited to these two exemplary embodiments, and other embodiments are also conceivable. These embodiments are a function of the appropriate selection of the positions of the pivot points. By appropriately positioning the pivot points within the plastic housing, the desired movement guidance of the blade member, and hence of the razor blades, can be achieved.

Pursuant to one preferred specific embodiment, each end of the swivel levers is provided with a respective bent-over tab through which extend round mounting rods that extend parallel to the cutting edge or edges of the razor blade or blades, and that are secured to the housing or to the blade member. This represents a technically straight-forward possibility for realizing the pivot points.

In order on the whole to be able to provide a stable movement mounting of the blade member, the swivel levers, in other words the width thereof, extends essentially over the entire length of the plastic housing, so that the entire width of the blade member is supported.

Pursuant to a further specific embodiment, it is proposed that a spring be disposed on at least one of the swivel levers, with this spring then being supported on another part of the razor head. For example, this other part of the razor head can be the plastic housing, the blade member, or the other swivel lever. The important thing is that the spring is supported in such a way that it effects a return force upon the blade member when the latter is deflected.

The spring is preferably integrally formed on the swivel lever. This represents a technically straightforward possibility for realizing the spring, and furthermore no additional part is required.

However, as an alternative a compression spring can be disposed between the rear wall of the plastic housing and either the blade member or one of the swivel levers. Such a compression spring that is supported between these two parts represents a technically straightforward possibility for being able to pivot the blade member back into the starting position.

Such a compression member is preferably a curved leaf-type or wire spring.

It is finally proposed pursuant to a further specific embodiment that the plastic housing and/or the blade member and/or the swivel levers define the stop means that delimit the pivoting movement relative to one another. In this way, the starting and end positions of the blade member during its movement within the plastic housing are prescribed.

Further specific embodiments of the present invention will be described in detail subsequently.

DESCRIPTION OF PREFERRED EMBODIMENTS

Figure 4:
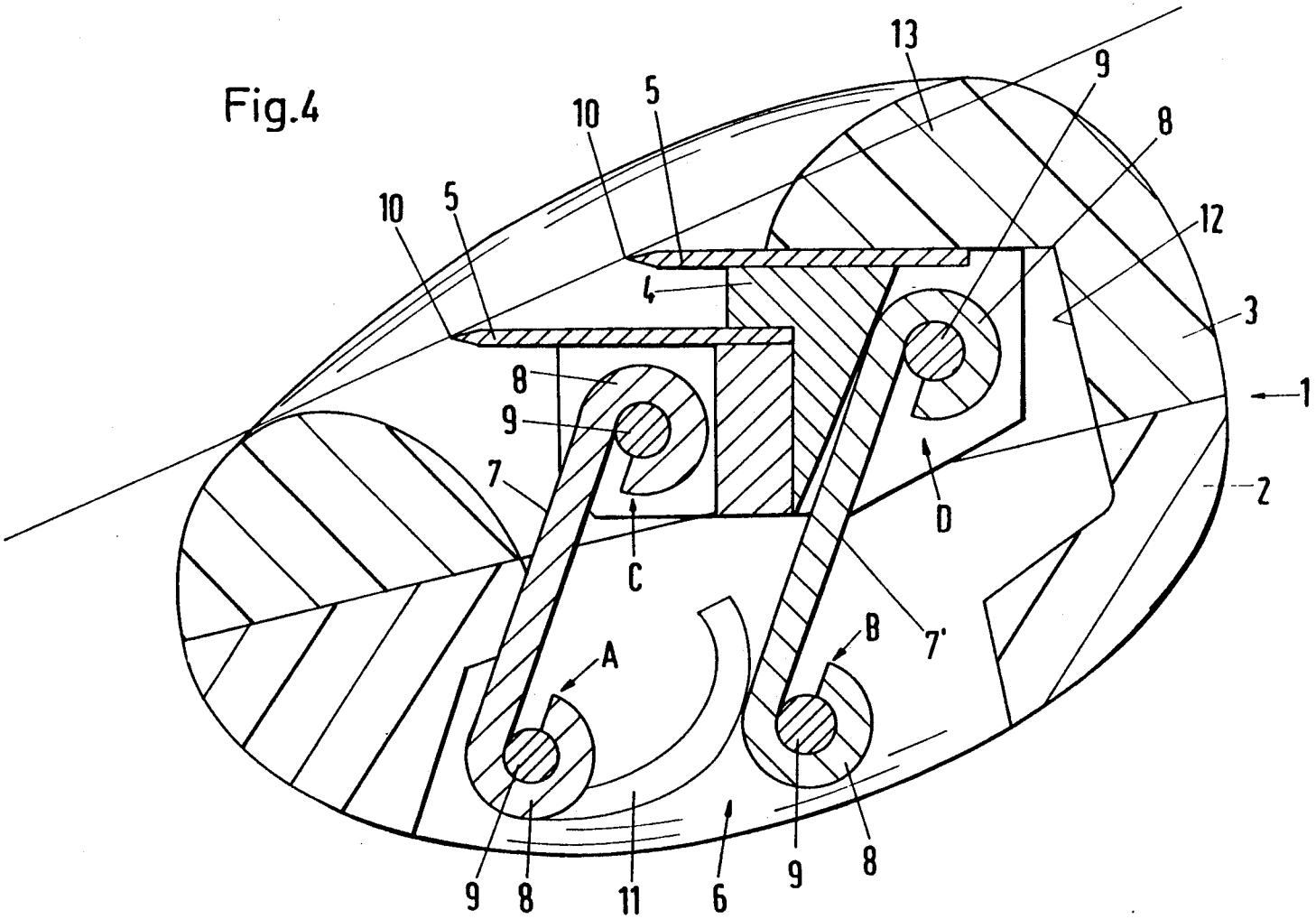
FIG. 4 is a cross-sectional view through the razor blade unit in the starting position of the blade member.
Figure 5:
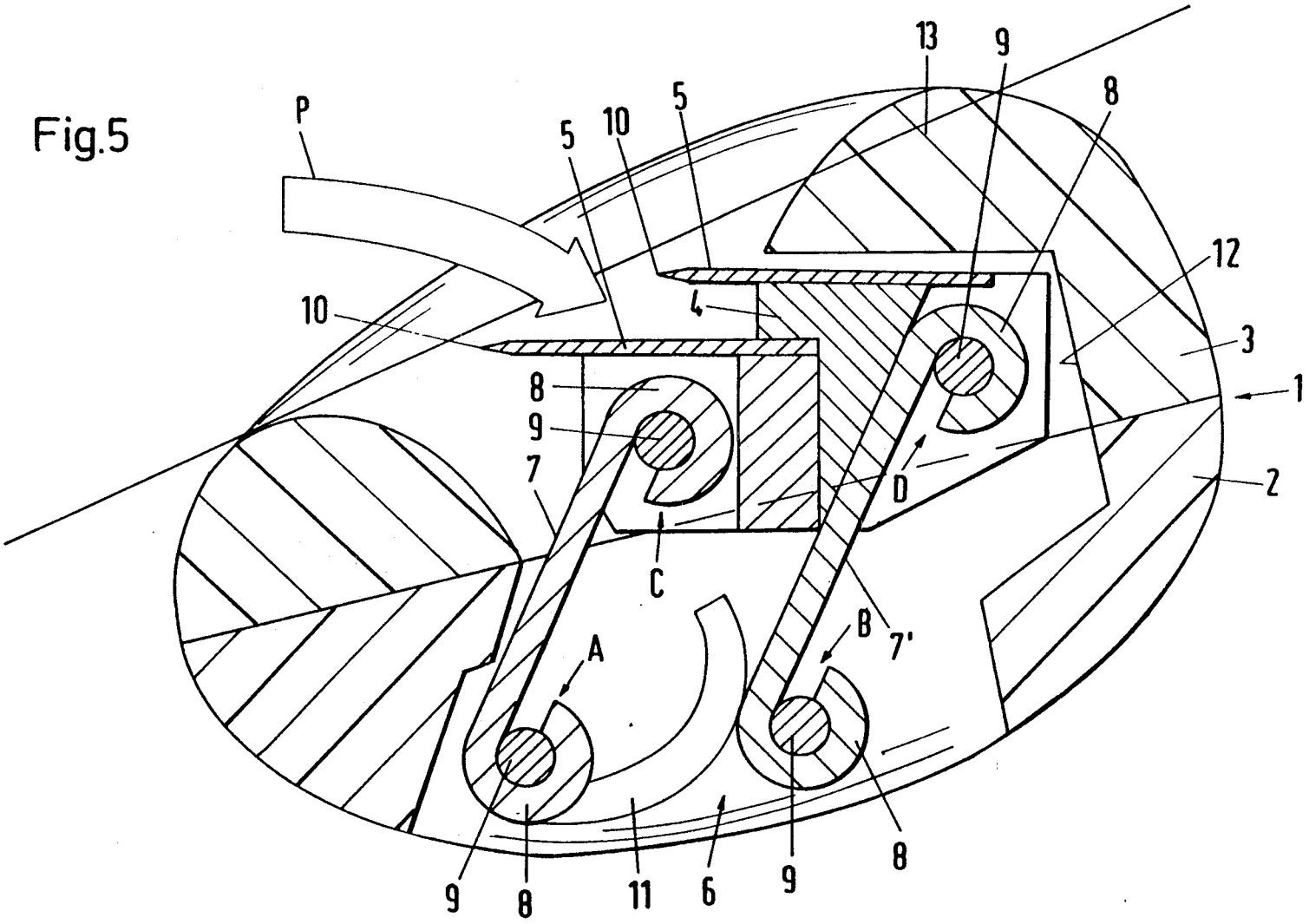
FIG. 5 is a cross-sectional view through the razor blade unit after the blade member has been pivoted.
Figure 6:
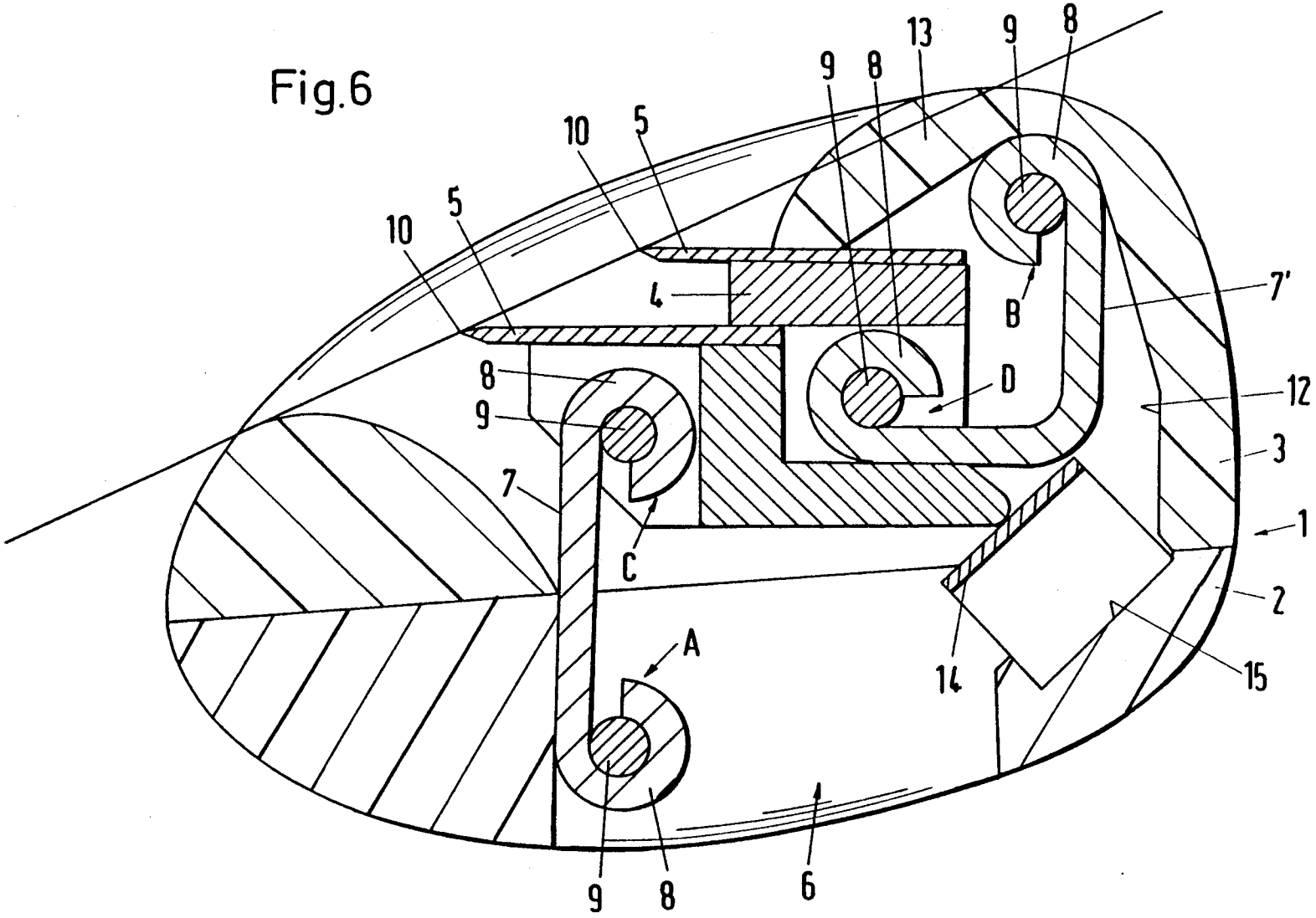
FIG. 6 is a cross-sectional view through a further exemplary embodiment of the inventive razor blade unit, with the blade member being in the starting position.
Figure 7:
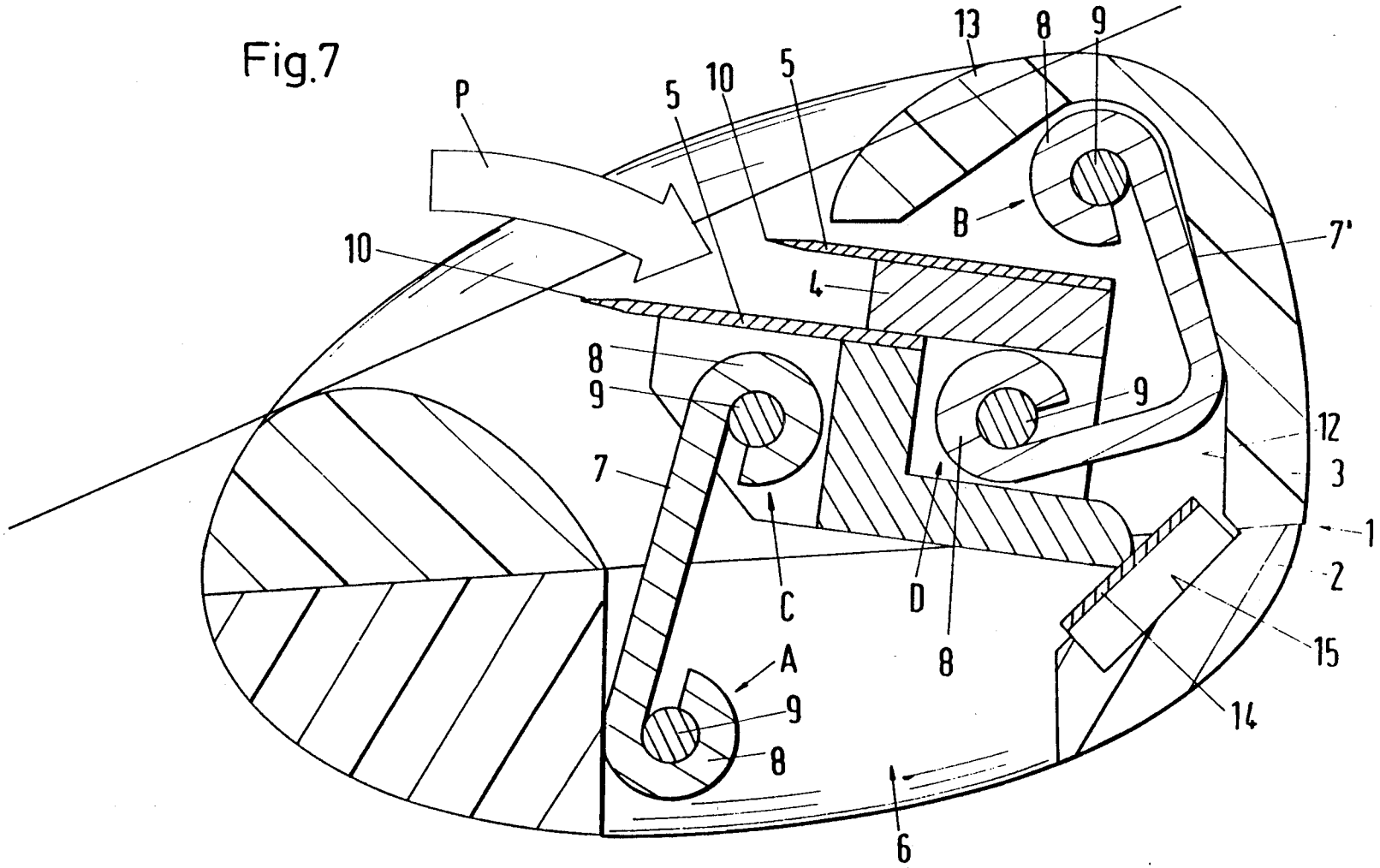
FIG. 7 is a cross-sectional view similar to FIG. 6, but after the blade member has been pivoted.

Referring now to the drawings in detail, FIGS. 1 to 5 illustrate a first exemplary embodiment of the inventive razor blade unit, while FIGS. 6 and 7 illustrate a second exemplary embodiment.

The first embodiment of the razor blade unit illustrated in FIGS. 1 to 5 comprises a plastic housing 1. This plastic housing is composed of a lower portion 2 and an upper portion 3, which can be appropriately placed upon one another and interconnected, for example by being fused or glued together, interlocked together, telescoped in one another, etc.

A blade member 4 is spring or yieldingly mounted within the plastic housing 1 between the lower portion 2 and the upper portion 3. By means of an appropriate mounting, the blade member 4 can carry out a combination of rotational and translatory movements. To form a double razor blade, two razor blades 5 are secured to the blade member 4, for example by being glued thereon or fused therewith.

The aforementioned mounting of the blade member 4 within the plastic housing for a combination rotational and translatory movement is realized via a so-called four-pivot articulation arrangement 6. This arrangement comprises two pivot or swivel levers 7, 7' that, as can be seen from FIG. 2, extend over the entire width of the plastic housing 1, in other words from the left side to the right side. These swivel levers 7, 7' are formed, for example, from an appropriately bent blank or from a molded plastic part. Each of the wide sides or ends of the swivel levers 7, 7' is provided with respective flanged or folded-over tabs 8. These tabs have a round inner recess and are pivotably mounted on mounting rods 9 to thereby form pivot joints A to D. In this connection, the mounting rods 9 extend parallel to the cutting edges 10 of the razor blades 5, whereby at the pivot joints A and B the mounting rods 9 are secured to the housing while at the pivot joints C and D the mounting rods 9 are secured to the blade member 4.

As can be seen from FIGS. 4 and 5 that illustrate the first exemplary embodiment, the pivot joints C and D are disposed at the front side and back side respectively of the blade member 4, while the pivot joints A and B are positioned at an angle from the front toward the rear in the plastic housing 1 so that the four pivot points A to D essentially form the corners of a parallelogram.

It can also be seen that a spring 11 is integrally formed on the swivel lever 7 and rests against the front side of the other swivel lever 7' and thus tries to turn the swivel lever 7 in a counterclockwise direction and into the normal or starting position.

FIG. 4 illustrates this normal or starting position of the blade member 4. During a shaving process, pressure is applied to the blade member 4, which has the effect that the blade member 4 is displaced in a direction toward the rear wall 12 of the plastic housing 1 in a combination rotational and translatory movement (indicated by the arrow P in FIG. 5). As soon as the application of pressure is discontinued, the blade member 4, as a consequence of the force of the spring 11, returns from the pivoted position illustrated in FIG. 5 to the starting position illustrated in FIG. 4. The starting position is defined by stop means between the plastic housing 1 and the swivel lever 7; similarly, the maximum pivot position is defined by stop means between the swivel lever 7' and the rear wall 12 of the plastic housing 1.

In the alternative embodiment illustrated in FIGS. 6 and 7, the pivot points A to D of the four-pivot articulation arrangement 6 are arranged somewhat differently. Although the pivot points A and C of the forward swivel lever 7 have a position corresponding essentially to that of the first embodiment, the pivot points B and D of the rear swivel 7' are arranged differently. In particular, the pivot point D is disposed somewhat within the blade member 4 at the rear side thereof. However, the primary difference is that the pivot point B, rather than being disposed in the lower region of the plastic housing 1, is disposed in the upper region thereof above the pivot point D and below the cap or cover means 13 of the plastic housing 1. For this purpose, the rear swivel lever 7' is also bent.

A further difference between the two embodiments is that with the second embodiment a compression spring 14 in the form of a leaf-type spring is supported between the rear wall 12 of the plastic housing 1 and the blade member 4. The spring 14 is accommodated in a recess 15 of the plastic housing 1.

Despite the aforementioned differences, the manner of operation of the second embodiment is similar to that of the first embodiment. In particular, the blade member 4 with its two razor blades 5 carries out a combined rotational and translatory movement when, starting from the normal or starting position illustrated in FIG. 6, a force is exerted upon the blade member 4, so that the blade member reaches the end position illustrated in FIG. 7, with this end position being delimited by a stop means between the rear swivel lever 7' and the rear wall 12 of the plastic housing 1.

It is to be understood that although only two possible embodiments of mounting the blade member via a four-pivot articulation arrangement are illustrated in the drawings, other embodiments are in principle also conceivable. The important advantage of mounting the blade member 4 within the plastic housing 1 via a four-point articulation arrangement 6 is in the achievement of a controlled and directed movement of the blade member 4 during a shaving process, so that a movement of the razor blades 5 on the blade member 4 can be achieved that is a combination rotational and translatory movement. Further advantages of the inventive system include the low frictional forces in the pivot points A to D as well as the insusceptibility to becoming dirty, since the swivel levers 7, 7' can be disposed only at the sides.

The present invention is, of course, in no way restricted to the specific disclosure of the specification and drawings, but also encompasses any modifications within the scope of the appended claims.

What we claim is:

1. A razor head, especially a razor blade unit of a wet razor, with said razor head being disposed at an end of a handle and comprising:

a plastic housing;

a blade member to which razor blade means having cutting edge means are secured, with said blade member being displaceably and yieldingly mounted in said plastic housing;

spring means disposed in said plastic housing for effecting said yielding mounting of said blade member; and a four-pivot articulation arrangement disposed in said plastic housing for effecting said displaceable mounting of said blade member, with said blade member being mounted on said four-pivot articulation arrangement and with said arrangement comprising two swivel levers, each of which has first pivot point means on said plastic housing and second pivot point means on said blade member, with said pivot point means having axes that extend parallel to said cutting edge means of said razor blade means, and with said swivel levers being pivotable about said axes against a spring force of said spring means.

2. A razor had according to claim 1, wherein one of said swivel levers is linked to a forward portion of said blade member and the other of said swivel levers is linked to a rearward portion of said blade member.

3. A razor head according to claim 2, wherein said one of said swivel levers that is linked to said forward portion of said blade member has an opposite end that is linked to a forward, lower portion of said plastic housing, and wherein said other of said swivel levers that is linked to said rearward portion of said blade member has an opposite end that is also linked to a lower portion of said plastic housing but rearwardly of where said one of said swivel levers is linked thereto.

4. A razor head according to claim 3, wherein said pivot point means essentially form the corners of a parallelogram.

5. A razor head according to claim 2, wherein said one of said swivel levers that is linked to said forward position of said blade member has an opposite end that is linked to a forward, lower portion of said plastic housing, and wherein said other of said swivel levers that is linked to said rearward portion of said blade member has an opposite end that is linked to a rear, upper portion of said plastic housing.

6. A razor head according to claim 5, wherein said plastic housing has a rear cover means, and said other of said swivel levers that is linked to said rear, upper portion of said plastic housing is linked essentially below said cover means.

7. A razor head according to claim 2, wherein said one of said swivel levers that is linked to said forward portion of said blade member has an opposite end that is linked to a central, lower portion of said plastic housing, and wherein said other of said swivel levers that is linked to said rearward portion of said blade member has an opposite end that is also linked to a lower portion of said plastic housing but rearwardly of where said one of said swivel levers is linked thereto.

8. A razor head according to claim 2, wherein said one of said swivel levers that is linked to said forward portion of said blade member has an opposite end that is linked to a central, lower portion of said plastic housing, and wherein said other of said swivel levers that is linked to said rearward portion of said blade member has an opposite end that is linked to a rear, upper portion of said plastic housing.

9. A razor head according to claim 1, wherein said swivel levers have ends, each of which is provided with a bent-over tab through which round mounting rods are guided that extend parallel to said cutting edge means of said razor blade means, with each of said mounting rods being secured to one of said plastic housing and said blade member.

10. A razor head according to claim 1, wherein said swivel levers have such a width that they essentially extend over the entire length of said plastic housing.

11. A razor head according to claim 1, wherein said spring means is disposed on at least one of said swivel levers and is supported against said razor head.

12. A razor head according to claim 11, wherein said spring means is integrally formed on said at least one swivel lever.

13. A razor head according to claim 1, wherein said plastic housing has a rear wall, and said spring means is a compression spring that is disposed between said rear wall of said plastic housing and said blade member.

14. A razor head according to claim 13, wherein said compression spring is a curved leaf-type spring.

15. A razor head according to claim 1, wherein said plastic housing has a rear wall, and said spring means is a compression spring that is disposed between said rear wall of said plastic housing and one of said swivel levers.

16. A razor head according to claim 15, wherein said compression spring is a curved wire spring.

17. A razor head according to claim 1, wherein at least one of said plastic housing, said blade member, and said swivel levers define, relative to one another, stop means that delimit a pivoting movement of said swivel levers.

* * * * *

UNITED STATES PATENT AND TRADEMARK OFFICE

CERTIFICATE OF CORRECTION

PATENT NO. : 5,222,300

DATED : June 29, 1993

INVENTOR(S) : Althaus et al

It is certified that error appears in the above-identified patent and that said Letters Patent is hereby corrected as shown below:

On the title page, item [73] Assignee should read as follows:

[73] Assignee: Wilkinson Sword Gesellschaft mit beschränkter Haftung, Solingen, Fed. Rep. of Germany Signed and Sealed this First Day of February, 1994

Bruce Lehman

*Attest:*

BRUCE LEHMAN

*Attesting Officer*

*Commissioner of Patents and Trademarks*